US012196512B1

(12) United States Patent
Hillis et al.

(10) Patent No.: US 12,196,512 B1
(45) Date of Patent: Jan. 14, 2025

(54) FIREARM TRIGGER ASSEMBLY WITH MULTI-STAGE FEATURE

(71) Applicants: Mitchell Hillis, Phoenix, AZ (US); Casey Hill, Phoenix, AZ (US); Peter Walther, Phoenix, AZ (US); Christopher Dillon, Phoenix, AZ (US)

(72) Inventors: Mitchell Hillis, Phoenix, AZ (US); Casey Hill, Phoenix, AZ (US); Peter Walther, Phoenix, AZ (US); Christopher Dillon, Phoenix, AZ (US)

( * ) Notice: Subject to any disclaimer, the term of this patent is extended or adjusted under 35 U.S.C. 154(b) by 0 days.

(21) Appl. No.: 18/239,606

(22) Filed: Aug. 29, 2023

(51) Int. Cl.

| | |
|---|---|
| ***F41A 19/16*** | (2006.01) |
| ***F41A 17/82*** | (2006.01) |
| ***F41A 19/10*** | (2006.01) |
| ***F41A 19/14*** | (2006.01) |

(52) U.S. Cl.
CPC ..... *F41A 19/16* (2013.01); *F41A 17/82* (2013.01); *F41A 19/10* (2013.01); *F41A 19/14* (2013.01)

(58) Field of Classification Search
CPC ..... F41A 19/14; F41A 19/16; F41A 19/17; F41A 19/15
USPC ..... 42/69.03
See application file for complete search history.

(56) References Cited

U.S. PATENT DOCUMENTS

| | | | | |
|---|---|---|---|---|
| 11,274,894 | B1 * | 3/2022 | Hill | F41A 17/46 |
| 12,078,435 | B2 * | 9/2024 | Torres | F41A 19/10 |

* cited by examiner

*Primary Examiner* — Reginald S Tillman, Jr.
(74) *Attorney, Agent, or Firm* — Newman Law, LLC

(57) ABSTRACT

Systems and methods for modifying the trigger assembly of a firearm to create different trigger pull weight stages during a pre-travel phase of the trigger, wherein the trigger pull weight of the pre-travel phase is greater than the trigger pull weight at the trigger breakpoint for the hammer to be released.

20 Claims, 9 Drawing Sheets

FIREARM TRIGGER ASSEMBLY WITH MULTI-STAGE FEATURE

BACKGROUND OF THE INVENTION

Field of the Invention

This invention is generally concerned with systems and methods for modifying the trigger action of a firearm, and more particularly, systems and methods for modifying the trigger pull weight during stages in the trigger pre-travel to the trigger breakpoint.

Background of the Art

Firearm triggers possess various characteristics relating to the trigger action, such as the distance and trigger pull weight of the pre-travel, breakpoint, over-travel and reset phases. The trigger pull weights, or forces, are exerted against, or in opposition to, the general direction of the trigger movement from the pre-travel through to the over-travel phases, whereas the force is exerted in the same general direction of trigger movement in the reset phase.

The firearm industry trend is to reduce the trigger pull weight and travel distance through the pre-travel phase to the trigger breakpoint. However, for various applications, having a reduced maximum pull weight and travel distance is undesirable.

Therefore, systems and methods are needed which address the deficiencies of the art as well as the needs of the industry and firearm users.

SUMMARY OF THE INVENTION

Systems and methods of the invention are directed to solving the problems mentioned above, among other things.

Some embodiments of the invention are directed to systems and methods for modifying the trigger assembly to create different trigger pull weight stages during a pre-travel phase of the trigger, wherein the pre-travel phase is divided into a first sear engagement condition and a second sear engagement condition occurring sequentially in the pre-travel phase until a trigger breakpoint is reached, the first sear engagement or biased condition having a first trigger pull weight and the second sear engagement or biased condition having a second trigger pull weight, wherein the first trigger pull weight is greater than the second trigger pull weight.

Some embodiments of the invention are directed to a trigger assembly for use in a firearm having a semi-automatic hammer-fired mechanism, the trigger assembly comprising: (a) a hammer including a cam portion, the hammer being mounted about an axial pin and biased by a hammer biasing force for forward pivotal motion by a hammer spring, the cam portion having a generally circular periphery, the generally circular periphery of the cam portion including: (i) a cutout therein having a bottom, a first side wall and a second side wall, the first side wall and the second side wall opposing one another, wherein the bottom, the first side wall and the second side wall define a radially inner receiving space; (ii) a first sear engagement shoulder, the first sear engagement shoulder comprising the first side wall of the cutout; and (iii) a second sear engagement shoulder, the second engagement shoulder comprising the second side wall of the cutout, the second side wall including an inner sear engagement surface and an outer sear engagement surface, the inner sear engagement surface being in a radially inner position relative to the outer sear engagement surface; (b) a trigger mounted for pivotal motion, the trigger including a forward portion, the forward portion having a front wall, the trigger being biased against rearward pivotal motion by a trigger spring applying a trigger biasing force to maintain the trigger in an unpulled position; wherein the trigger assembly is configured to enable a first biased condition and a second biased condition; wherein the first biased condition comprises the forward portion in contact with the first engagement shoulder, the front wall of the forward portion in contact with the inner sear engagement surface of the second engagement shoulder, and the trigger in the unpulled position, whereby the cam portion is restrained preventing the hammer biasing force from causing the hammer to be released for forward biased motion; wherein the second biased condition comprises the front wall of the forward portion in contact with the outer sear engagement surface of the second engagement shoulder, whereby the cam portion is restrained preventing the hammer biasing force from causing the hammer to be released for forward biasing motion and the trigger biasing force is negated preventing the trigger from returning to the unpulled condition; wherein, responsive to applying at least a trigger breakpoint force to cause pivotal motion of the trigger in the second biased condition, the front wall of the forward portion disengages from contact with the outer sear engagement surface, whereby the cam portion is unrestrained and the hammer biasing force causes the hammer to be released for forward biasing motion; wherein the trigger biasing force is greater than the trigger breakpoint force.

In some embodiments, the cutout further comprises an arcuate inner surface.

In some embodiments, the first sear engagement shoulder includes a planar contact surface configured to contact the forward portion in the first biased condition.

In some embodiments, the inner sear engagement surface and the outer sear engagement surface extend at different angles with respect to one another. The outer sear engagement surface may also at least partially form a chamfer in the second sear engagement shoulder.

In some embodiments, the front wall defines a lower wall portion and an upper wall portion, the upper wall portion contacting the outer sear engagement surface in the second biased condition. The upper wall portion may also be tapered at a different angle with respect to the lower wall portion.

In some embodiments, the trigger biasing force is about twice as strong as the trigger breakpoint force.

In some embodiments, the forward portion is not in contact with the first engagement shoulder and the front wall of the forward portion is not in contact with the inner sear engagement surface of the second engagement shoulder in the second biased condition.

Some embodiments of the invention are also directed to a trigger assembly for use in a firearm having a semi-automatic hammer-fired mechanism, the trigger assembly comprising: (a) a hammer including a cam portion, the hammer being mounted about an axial pin and biased by a hammer biasing force for forward pivotal motion by a hammer spring, the cam portion having a generally circular periphery, the generally circular periphery of the cam portion including: (i) a cutout therein having a bottom, a first side wall and a second side wall, the first side wall and the second side wall opposing one another, wherein the bottom, the first side wall and the second side wall define a radially inner receiving space; (ii) a first sear engagement shoulder, the first sear engagement shoulder comprising the first side wall of the cutout; and (iii) a second sear engagement shoulder, the second engagement shoulder comprising the second side wall of the cutout, the second side wall including an inner sear engagement surface and an outer sear engagement surface, the inner sear engagement surface being in a radially inner position relative to the outer sear engagement surface; (b) a trigger mounted for pivotal motion, the trigger including a forward portion, the forward portion having a front wall, the trigger being biased against rearward pivotal motion by a trigger spring applying a first trigger pull weight to maintain the trigger in an unpulled position; wherein the forward portion is configured to be in contact with the first engagement shoulder and the front wall is configured to be in contact with at least the inner sear engagement surface in a first biased condition; wherein the first trigger pull weight on the forward portion is configured to apply resistance to pivotal motion of the trigger in the first biased condition; wherein the front wall of the forward portion is configured to move from the first biased condition to a second biased condition responsive to pivotal motion of the trigger overcoming the first trigger pull weight; wherein the front wall of the forward portion is configured to be in contact with only the outer sear engagement surface in the second biased condition; wherein a second trigger pull weight on the forward portion is configured to apply resistance to pivotal motion of the trigger in the second biased condition, whereby the hammer is prevented from being released; wherein the hammer is configured to release responsive to pivotal motion of the trigger overcoming the resistance of the second trigger pull weight; and wherein the first trigger pull weight is greater than the second trigger pull weight.

In some embodiments the inner sear engagement surface is positioned at a first slope and the outer sear engagement surface is positioned at a second slope, the first slope and second slope being different from one another.

In some embodiments the first trigger pull weight is about twice as strong as the second trigger pull weight.

Additionally, the invention is directed to an improvement to a trigger assembly in an enhanced fire-control system for use in a firearm having a semi-automatic hammer-fired mechanism, the enhanced fire-control system including a primary trigger; a secondary trigger pivotably connected to the primary trigger; and a trigger stop located substantially externally to the primary trigger and the secondary trigger and having a stop riser; wherein the secondary trigger actuates force on trigger stop when the secondary trigger is pulled, and wherein the stop riser limits breaking of a sear interface between the primary trigger and the firearm's hammer unless the secondary trigger is pulled.

In some embodiments, the improvement to the trigger assembly in the aforementioned enhanced fire-control system comprises: (a) a hammer including a cam portion, the hammer being mounted about an axial pin and biased by a hammer biasing force for forward pivotal motion by a hammer spring, the cam portion having a generally circular periphery, the generally circular periphery of the cam portion including: (i) a cutout therein having a bottom, a first side wall and a second side wall, the first side wall and the second side wall opposing one another, wherein the bottom, the first side wall and the second side wall define a radially inner receiving space; (ii) a first sear engagement shoulder, the first sear engagement shoulder comprising the first side wall of the cutout; and (iii) a second sear engagement shoulder, the second engagement shoulder comprising the second side wall of the cutout, the second side wall including an inner sear engagement surface and an outer sear engagement surface, the inner sear engagement surface being in a radially inner position relative to the outer sear engagement surface; (b) the primary trigger being mounted for pivotal motion, the trigger including a forward portion, the forward portion having a front wall, the trigger being biased against rearward pivotal motion by a trigger spring applying a trigger biasing force to maintain the trigger in an unpulled position; wherein the trigger assembly is configured to enable a first biased condition and a second biased condition; wherein the first biased condition comprises the forward portion in contact with the first engagement shoulder, the front wall of the forward portion in contact with the inner sear engagement surface of the second engagement shoulder, and the trigger in the unpulled position, whereby the cam portion is restrained preventing the hammer biasing force from causing the hammer to be released for forward biased motion; wherein the second biased condition comprises the front wall of the forward portion in contact with the outer sear engagement surface of the second engagement shoulder, whereby the cam portion is restrained preventing the hammer biasing force from causing the hammer to be released for forward biasing motion and the trigger biasing force is negated preventing the trigger from returning to the unpulled condition; wherein, responsive to applying at least a trigger breakpoint force to cause pivotal motion of the trigger in the second biased condition while pulling the secondary trigger, the front wall of the forward portion disengages from contact with the outer sear engagement surface, whereby the cam portion is unrestrained and the hammer biasing force causes the hammer to be released for forward biasing motion; wherein the trigger biasing force is greater than the trigger breakpoint force.

In some embodiments of the improvement described herein, the inner sear engagement surface and the outer sear engagement surface have different angled slopes with respect to one another.

In some embodiments of the improvement described herein, the forward portion is not in contact with the first engagement shoulder and the front wall of the forward portion is not in contact with the inner sear engagement surface of the second engagement shoulder in the second biased condition.

Other features of embodiments of the invention will be apparent from the drawings taken in conjunction with the detailed description that follows.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

Figure 1:
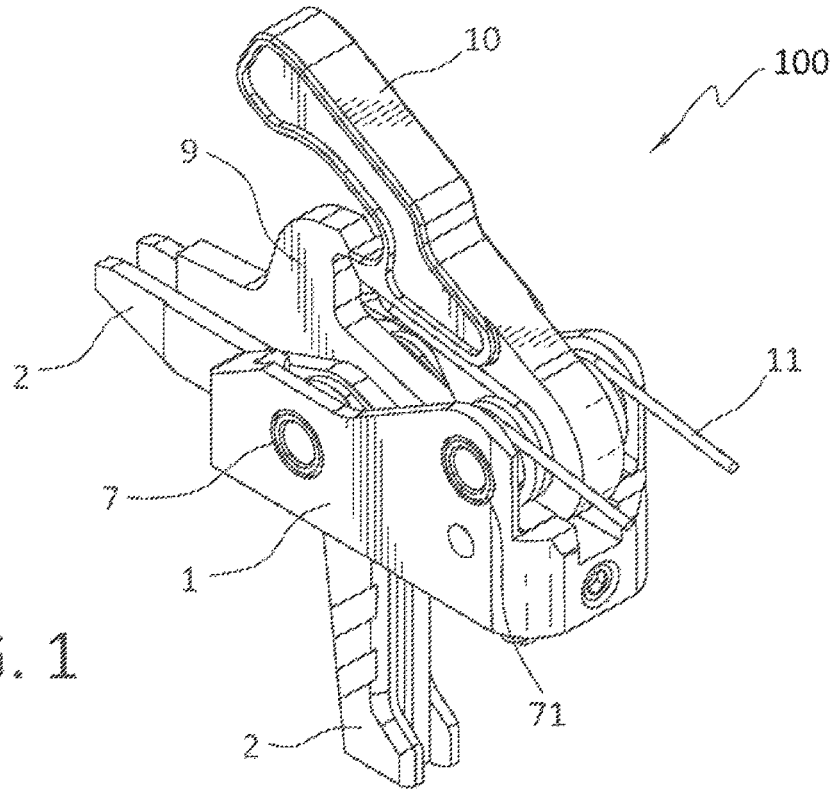
FIGS. 1-3 are, respectively, perspective, right side and left side views of the exterior of a drop-in trigger assembly comprising a fire-control system according to an embodiment of the invention.
Figure 2:
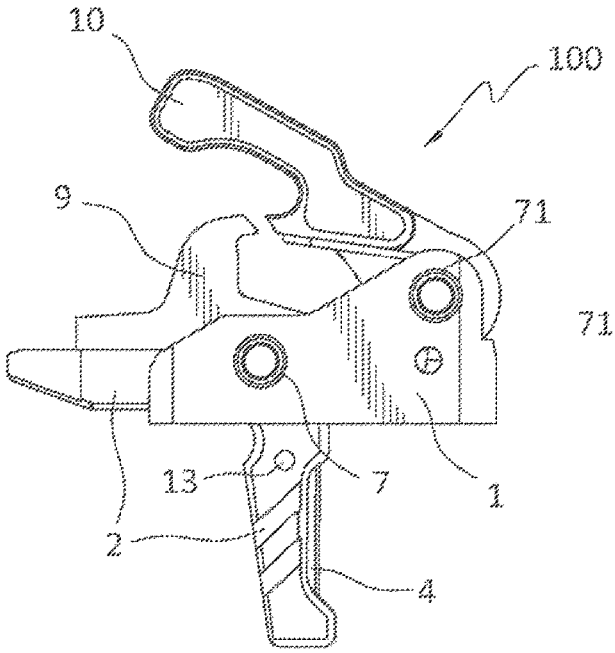
Figure 3:
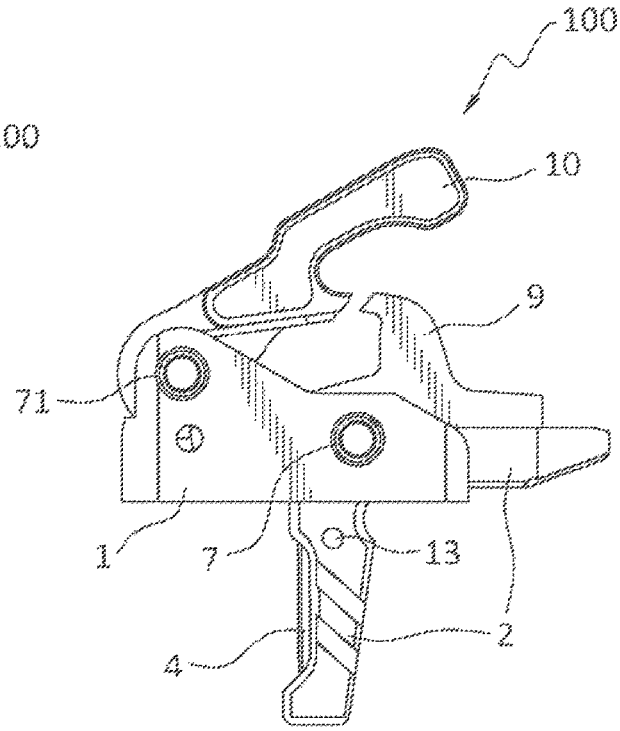
Figure 4:
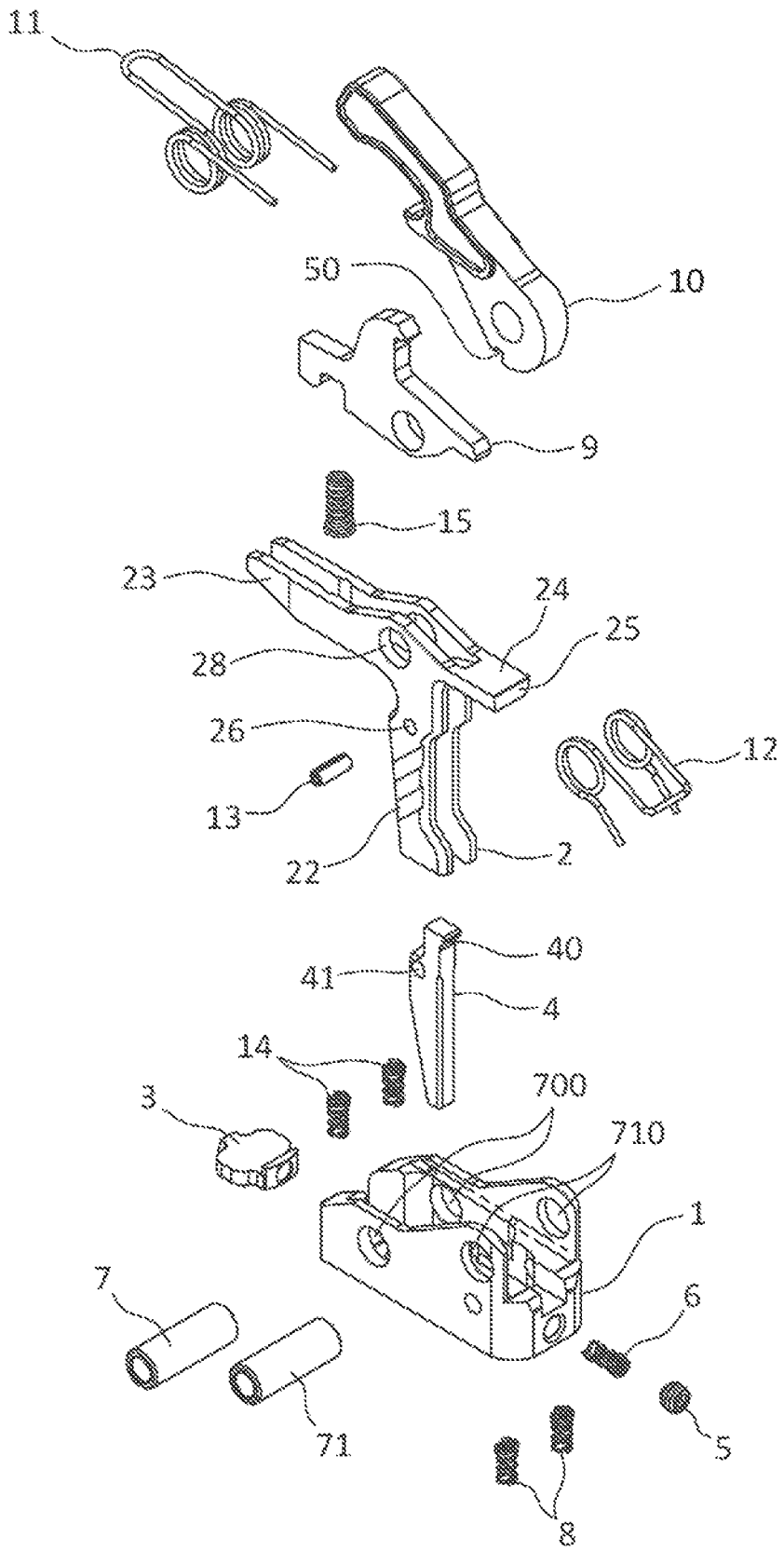
FIG. 4 is an exploded view of various components of a drop-in trigger assembly comprising a fire-control system according to an embodiment of the invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the invention.

DETAILED DESCRIPTION OF SOME EMBODIMENTS OF THE INVENTION

The exemplary embodiments of the invention disclosed herein illustrate various elements and features of the invention that can be embodied in many different forms and environments, and should not be construed as limited to the embodiments set forth herein. The following description is therefore not to be taken in a limiting sense, but is made merely for the purpose of describing the general principles of these exemplary embodiments.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In this description, various aspects of selected embodiments are described. However, it will be apparent to those of ordinary skill in the art and others that alternate embodiments may be practiced with only some or all of the aspects. For purposes of explanation, specific numbers, materials and configurations are set forth in order to provide a thorough understanding of the embodiments. However, it will be apparent to those of ordinary skill in the art and others that alternate embodiments may be practiced without the specific details. In some instances, well-known features are omitted or simplified in order not to obscure the illustrated embodiments.

Various operations may be described herein as multiple discreet steps in turn, in a manner that is helpful to understanding of the embodiments. However, the order of description should not be construed to imply that these operations are necessarily order dependent. In particular, these operations may not be performed in the order of presentation.

Reference throughout this specification to "one embodiment," "an embodiment," "for example" or similar language means that the embodiment(s) or example(s) may include a particular feature, structure, characteristic, property, element, or limitation but that not every embodiment or example necessarily includes that particular feature, structure, characteristic, property, element, or limitation. Further, repeated use of the phrases "in an embodiment" and "in some embodiments" do not necessarily refer to the same embodiment.

It will be further understood that the terms "includes", "including", "comprises", and/or "comprising," when used in this specification, specify the presence of stated features, steps, operations, elements, and/or components, but do not preclude the presence or addition of one or more other features, steps, operations, elements, and/or components.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Moreover, many references are made throughout this specification to approximate values and ranges. The terms "approximate" or "about" as used herein are meant simply to account for various tolerances and reasonable variances as may exist in manufacturing and testing procedures as are readily understood by those having skill in the art. For example, reference to an approximate value may inherently include a tolerance or variance of 0.10%, 1%, 5%, 10%, or anything in between, as would be deemed appropriate by one having skill in the relevant art with regard to the specific item or concept to which the value or range pertains.

FIGS. 1, 2, 3 and 4 illustrate an embodiment of the trigger assembly system and components constructed in accordance with the invention generally referred to by the numeral 100. In this embodiment, trigger assembly system 100 also includes a secondary trigger firing control system which must also be pulled or actuated to cause a firearm with the trigger assembly 100 to discharge. It should be understood that trigger assembly 100 and other embodiments of the invention disclosed herein may be implemented in many different types of trigger assemblies and firearms, including a trigger assemblies or firearms that do not include the secondary trigger firing control system shown in this embodiment.

System 100 includes housing 1 having at least two sets of apertures 700, 710 for receiving bushing 7 and bushing 71 and the various components identified below which may be seated partially or fully therein.

A primary trigger 2 includes a lower portion 22, a rearward portion 23, a forward portion 24, a leading edge 25, a trigger spring 12, an aperture 26 for receiving a pin coil spring 13, a relief cut or channel 27 in the lower portion 22 for receiving a secondary trigger 4, and an aperture 28 for receiving a bushing 7.

A secondary trigger 4 includes a projection 40, an aperture 41 for receiving pin coil spring 13, and a coil pin spring 13 around which primary trigger 2 and secondary trigger 4 pivot.

A trigger stop 3 includes a proximal end 31, a distal end 32, a top surface 33, a stop riser 34 on a portion of surface 33 near distal end 32, a stop face 35 on stop riser 34, a bottom surface 36, a front surface 37, a recess 38 on the front surface 37 for receiving compression spring 6 against which trigger stop 3 is biased, and a back surface 39.

A set screw 5 is included for containing compression spring 6 to housing 1. Compression springs 8, 14 are used in multiple locations for tensioning housing 1 in a firearm receiver.

Housing 1 further includes a disconnect 9, a hammer 10 having a cam end 52 with a notch/recess 50. Bushing 7 traverses through apertures 700 in side walls of housing 1, through apertures 28 in the primary trigger 2, through the coiled portion of trigger spring 12, and upon which disconnect 9 is seated. Bushing 71 traverses through apertures 710 in side walls of housing 1 and through the coiled portion of hammer spring 11, and upon which hammer 10 is seated. A trigger sear interface 51 and compression spring 15 for seating the disconnect 9 are also shown.

Primary and secondary triggers 2, 4 are pivotally connected to one another via a pin 13. The primary and secondary triggers are pivotable with respect to one another; in other words, secondary trigger 4 is pivotable on pin 13 without resulting in pivoting of primary trigger 2. Primary and secondary triggers are rotatably mounted within the housing 1. Primary trigger 2 is approximately t-shaped, comprising lower portion 22, rearward portion 23 and forward portion 24. The lower portion 22 is intended to be pulled by a user's finger, and includes a relief cut or channel 27 to allow the inset and outset of the secondary trigger 4. "Inset" of the secondary trigger occurs when the secondary trigger is pulled, and "outset" is the position of the secondary trigger prior to pulling or after it is reset. The primary trigger and secondary trigger pivot around a pin within the fire-control assembly and are biased by trigger spring 12 in the direction opposing or against being pulled, thus requiring overcoming the bias or resistance force to discharge the firearm. A trigger stop that is contained within the assembly is able to move in and out of a predetermined position by actuating or pulling the secondary trigger.

In this embodiment, trigger stop 3 is able to move in and out of a predetermined position by use of the secondary trigger and a spring like mechanism. Pulling (i.e., actuating) the secondary trigger permits the trigger sear interface between the primary trigger and the firearm's hammer to be broken. If the secondary trigger is in its non-pulled position, it limits the user's ability to break the trigger sear interface.

In this embodiment, when the secondary trigger 4 is pulled, it causes the trigger stop 3 to move in a substantially lateral direction away from the user, thereby providing an expanded space within which the primary trigger 2 can downwardly rotate into. In other words, when the secondary trigger 4 is pulled, it provides the front end of the primary trigger with a pathway within which to drop downward (into the space or gap on the top of the trigger stop 3).

In the cocked position, the hammer sear remains in position being held by a sear face stop positioned in a manner to impede the motion of the sear so as to not allow the trigger sear faces to break contact. The secondary trigger 4 interfaces with trigger stop 3 in a manner to move the stop in and out of position when the secondary trigger 4 is pulled independently of the pulling of the primary trigger 2.

Pull-through mode occurs as follows: if the primary trigger 2 is pulled without pulling the secondary trigger 4, the trigger stop 3 will be an impediment and will resist breaking the trigger sear interface, thereby resisting discharge of the firearm. If the secondary trigger 4 and primary trigger 2 are pulled simultaneously, the trigger sear face breaks and the firearm discharges. If the primary trigger 2 is pulled first, and the secondary trigger 4 is pulled second, the trigger sear face breaks and the firearm discharges. In either of these two pull-through scenarios, the user will need to use greater force to pull the trigger than if instead the secondary trigger 4 was pulled followed by the primary trigger 2 being pulled.

If only the primary trigger 2 is pulled, i.e., without the secondary trigger being pulled before, after or simultaneously with it, the trigger sear face cannot break, and therefore the firearm cannot discharge.

In the pre-stage position, the secondary trigger 4 must be pulled prior to pulling primary trigger 2 in order to position the trigger stop 3 in a manner to permit the trigger sear faces to break contact. The primary trigger 2 can then be pulled thus causing the trigger sear faces to break contact moving the fire-control into a fired position. The cycle of the weapon will re-cock the hammer and be retained in an over-cocked position being held by a disconnect sear. The disconnect sear will release upon the release of the primary trigger, thus resetting the fire-control into the cocked position.

Figure 6:
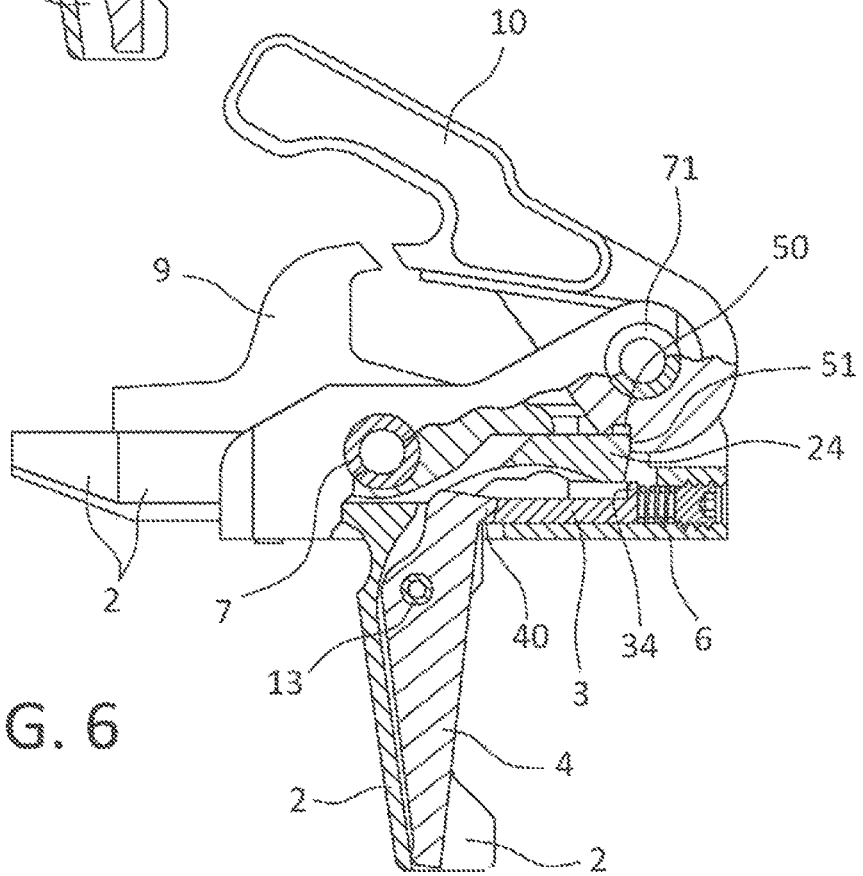
Figure 7:
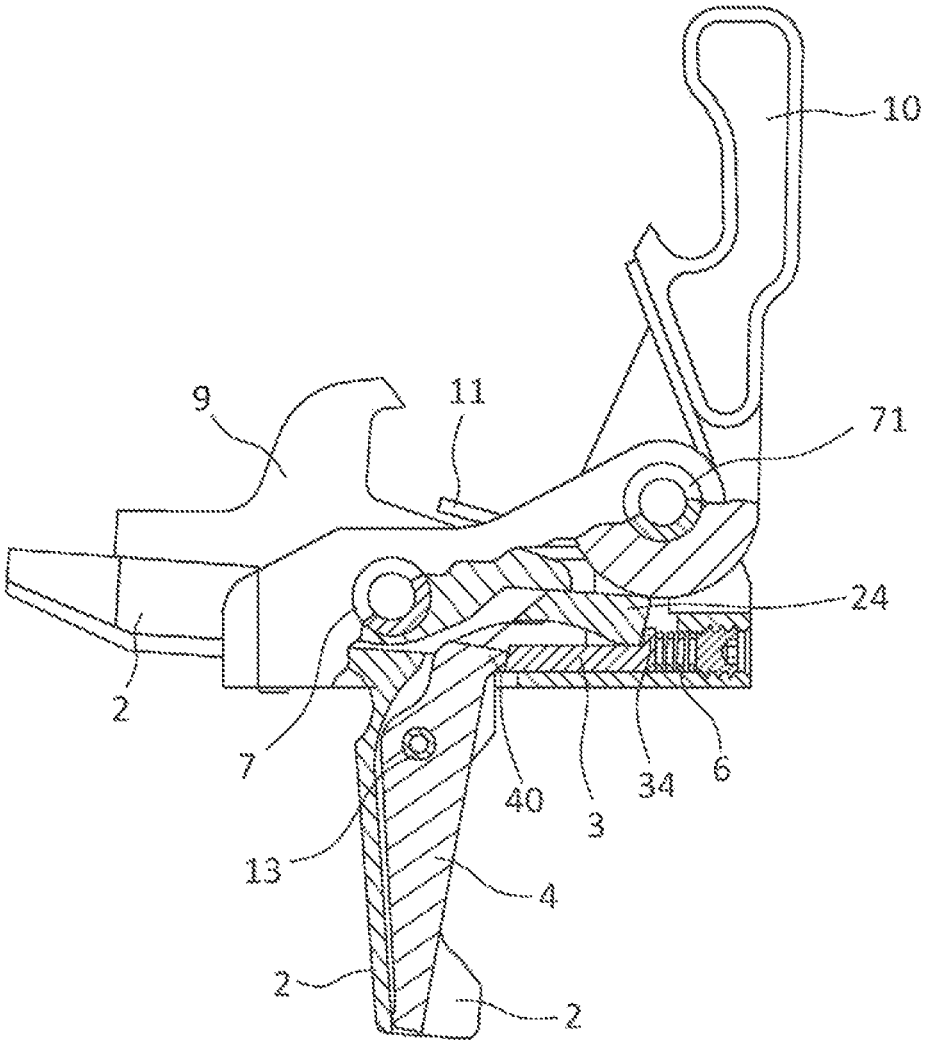

In one embodiment, when the secondary trigger 4 is pulled, it causes the trigger stop 3 to be displaced, wherein the trigger stop moves in a substantially linear direction away from the secondary trigger 4 and the user. As the trigger stop 3 moves, it applies force against compression spring 6 which is biased against an inner portion of housing 1. As illustrated in the drawing figures, especially FIGS. 5-7, the movement or displacement of trigger stop 3 that is caused by pulling secondary trigger 4 results in formation of a space or passage through which the forward portion 24 of the primary trigger 2 may drop downward into, thereby causing the contact between trigger sear interface 51 (located at forward portion 24 of primary trigger 2) and hammer 10 to break, resulting in discharge of the firearm.

Figure 5:
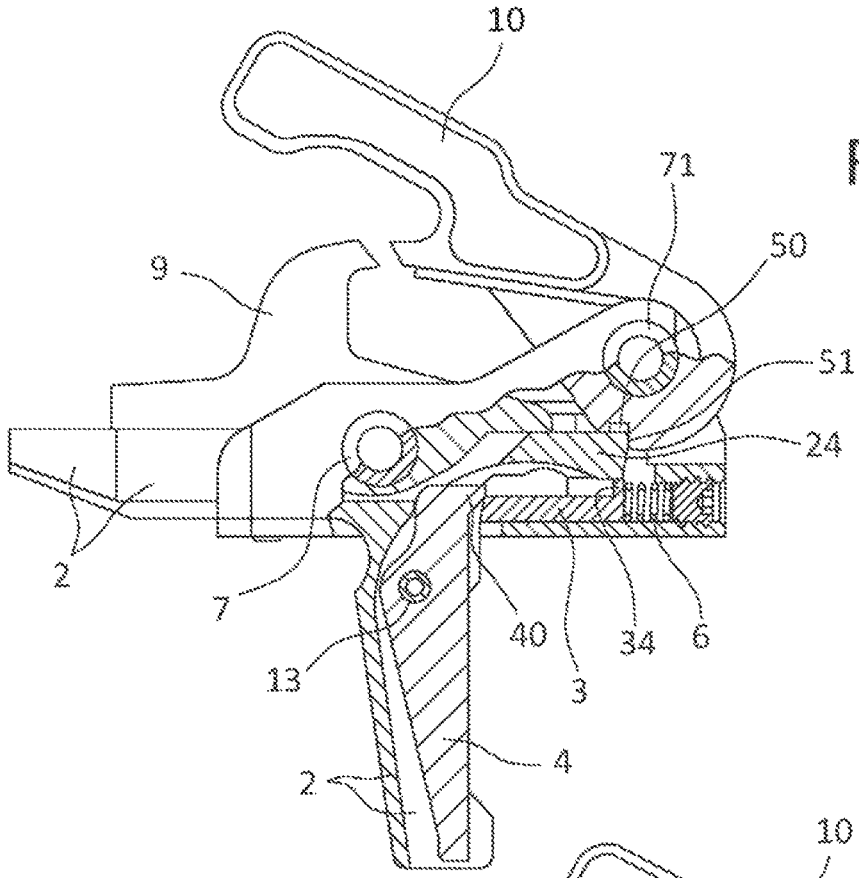
FIGS. 5, 6 and 7 are cross-sectional views of a drop-in trigger assembly comprising a fire-control system according to an embodiment of the invention, showing the assembly in the cocked, staged, and fired positions, respectively.

Hammer 10 includes a notch or relief cutout 50 which is releasably engaged by and biased against a portion of the top of the forward portion 24 of primary trigger 2. This renders the hammer 10 substantially unmovable in its cocked position whilst the secondary trigger 4 is in its resting, non-pulled position, as shown in FIG. 5. If the secondary trigger 4 has not yet been pulled, a portion of the underside of the forward portion of primary trigger 2 rests on the stop face 35 of step riser 34 of trigger stop 3.

In the embodiment shown in FIGS. 8-12 and generally designated as system 200, hammer 210 includes a cutout 250 in cam portion 252 defining a radially inner receiving space 254 relative to the axis formed by bushing 271 and a pin 273 inserted through bushing 271 forming the axial pivot point about which cam portion 252 is mounted to enable pivotal motion of hammer 210. Hammer 210 is biased for forward pivotal motion by a hammer biasing force, such as by a hammer spring, among other things. Cutout 250 has opposing side walls 257 and 259 as discussed below and further includes an arcuate inner surface 256 defining space 254.

A trailing or first sear engagement shoulder 258 is defined in cam portion 252 adjacent to space 254 comprising side wall 257 of cutout 250. First sear engagement shoulder 258 includes a contact surface 260 positioned circumferentially along cam portion 252, which in this embodiment is substantially flat or planar.

A leading or second sear engagement shoulder 262 is defined in cam portion on the opposing side of space 254 comprising side wall 259 of cutout 250. Side wall 259 of second sear engagement shoulder 262 includes an inner sear engagement surface 264 and an outer sear engagement surface 266. Inner sear engagement surface 264 is in a radially inner position and outer sear engagement surface 266 is in a radially outer position relative to the axis formed by bushing 271 and pin 273. Inner sear engagement surface 264 and outer sear engagement surface 266 may be positioned at different angles with respect to one another, that is outer sear engagement surface 266 may be sloped or tapered as compared with inner sear engagement surface 264, such as at an angle from about 0.5 degrees to about 60 degrees relative to inner sear engagement surface 264. For example, outer sear engagement surface 266 may form a chamfer in second sear engagement shoulder 262.

Figure 8:
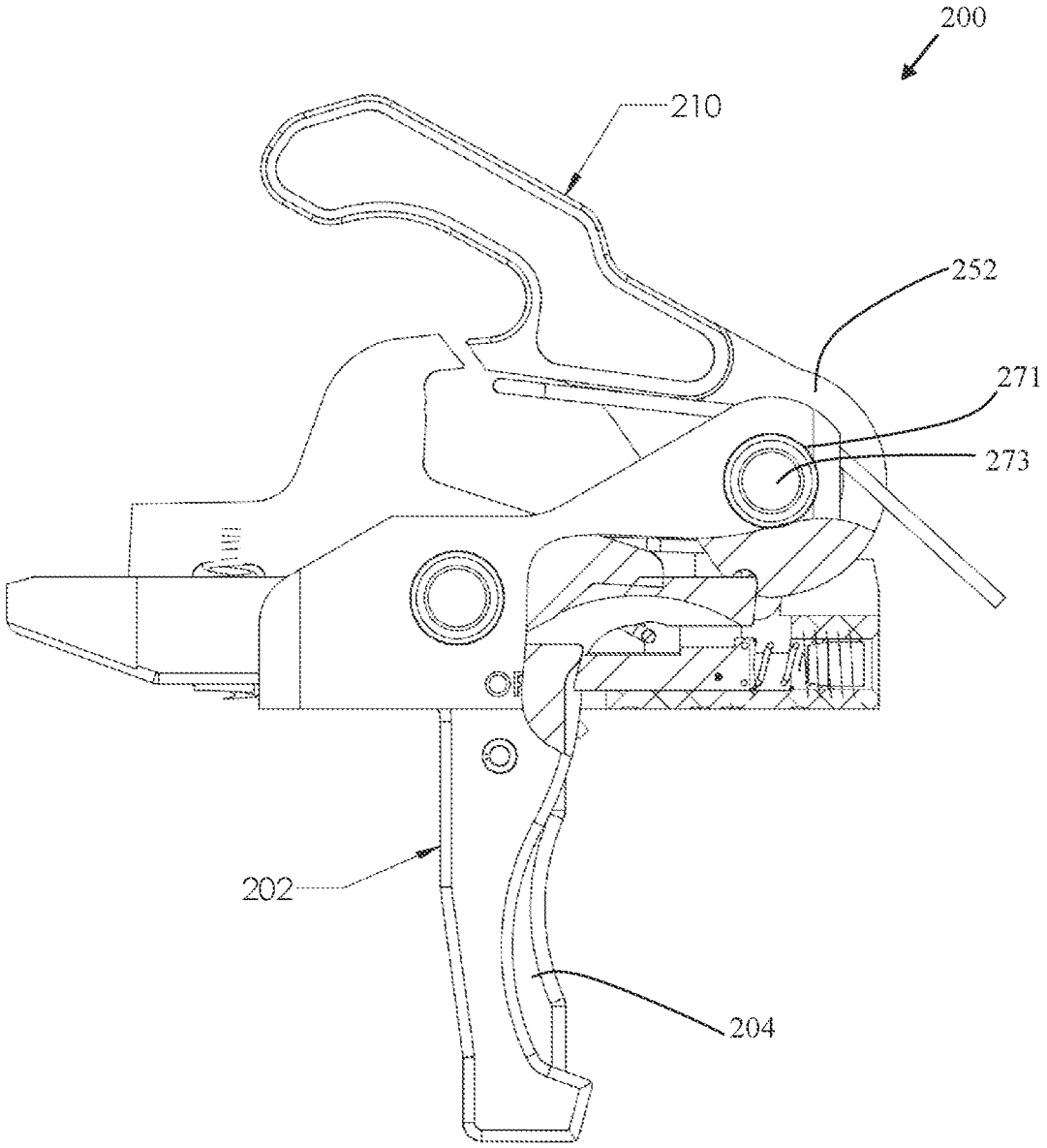
FIG. 8 provide a cross-sectional view of a trigger assembly according to an embodiment of the invention.
Figure 9:
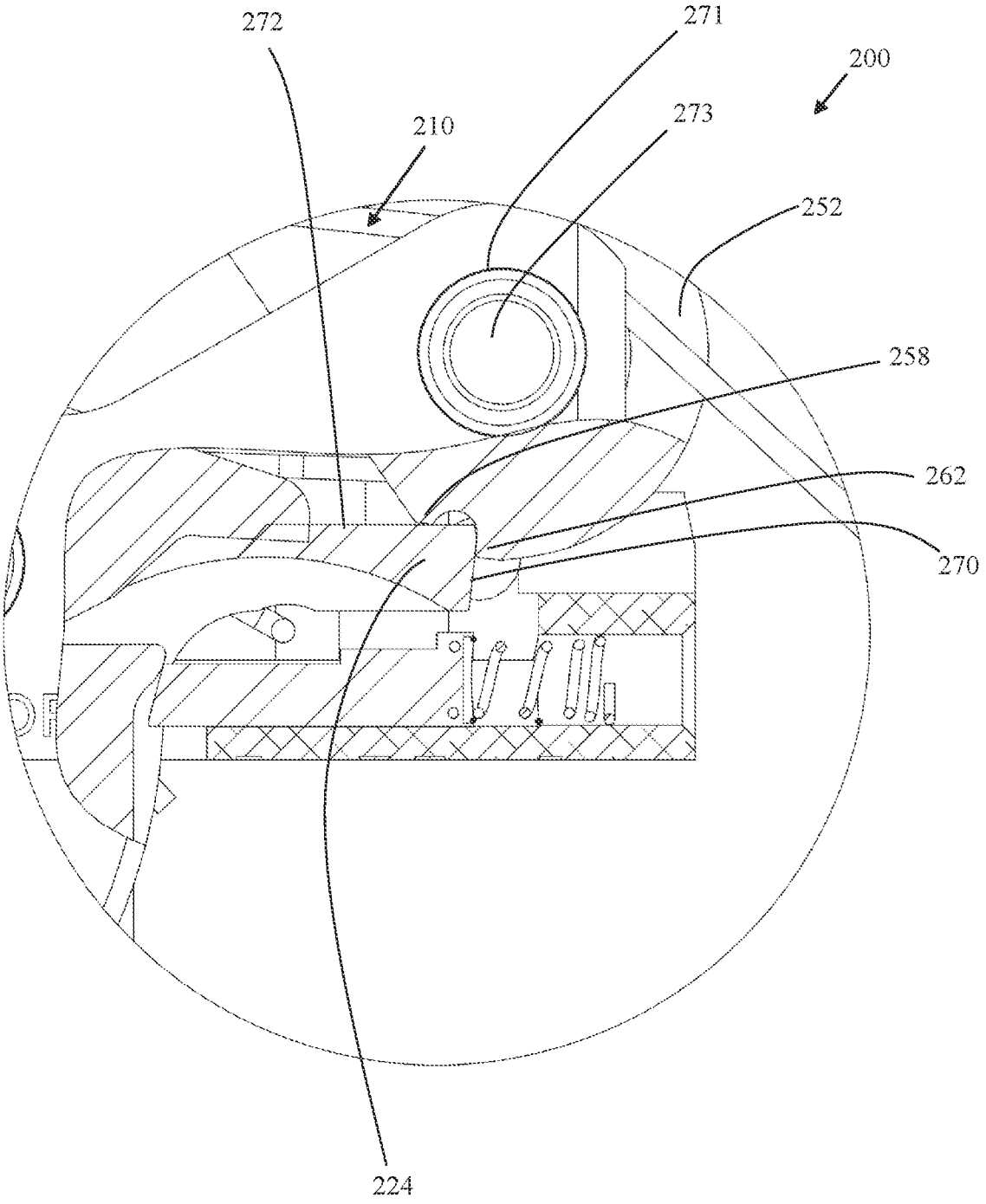
FIG. 9 is a depiction of a portion of the cross-sectional view of the embodiment of the invention shown in FIG. 8.
Figure 10:
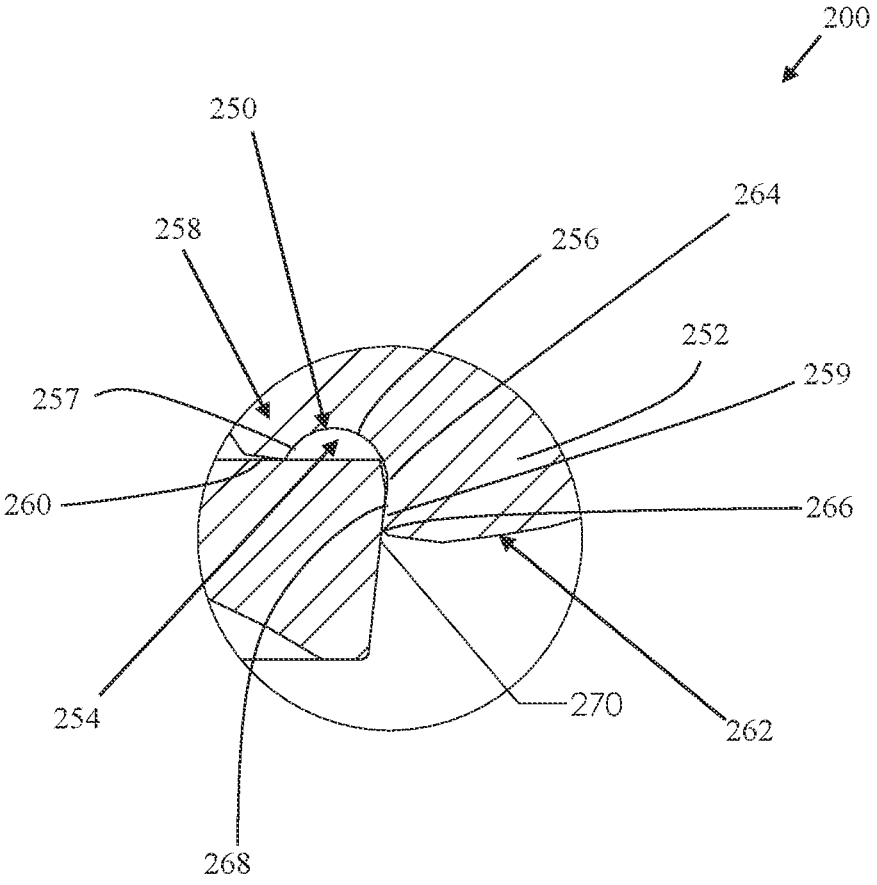
FIG. 10 is a depiction of a portion of the cross-sectional view of the embodiment of the invention shown in FIG. 8, illustrating, among other things, a close-up view of the trigger assembly in the first sear engagement or biased condition of the trigger and hammer.

In this embodiment, a first sear engagement condition, as shown in FIGS. 8-10, is formed by forward portion 224 being positioned within arcuate receiving space 254 with a first portion 268 of a front wall 270 of forward portion 224 in contact with at least inner sear engagement wall surface 264, or both inner sear engagement surface 264 and outer sear engagement surface 266, and contact surface 260 of first engagement shoulder 258 being in contact with an upper side wall 272 of forward portion 224. First sear engagement condition is biased by the application of force against pivotal movement of primary trigger 202 and/or secondary trigger 204.

Figure 11:
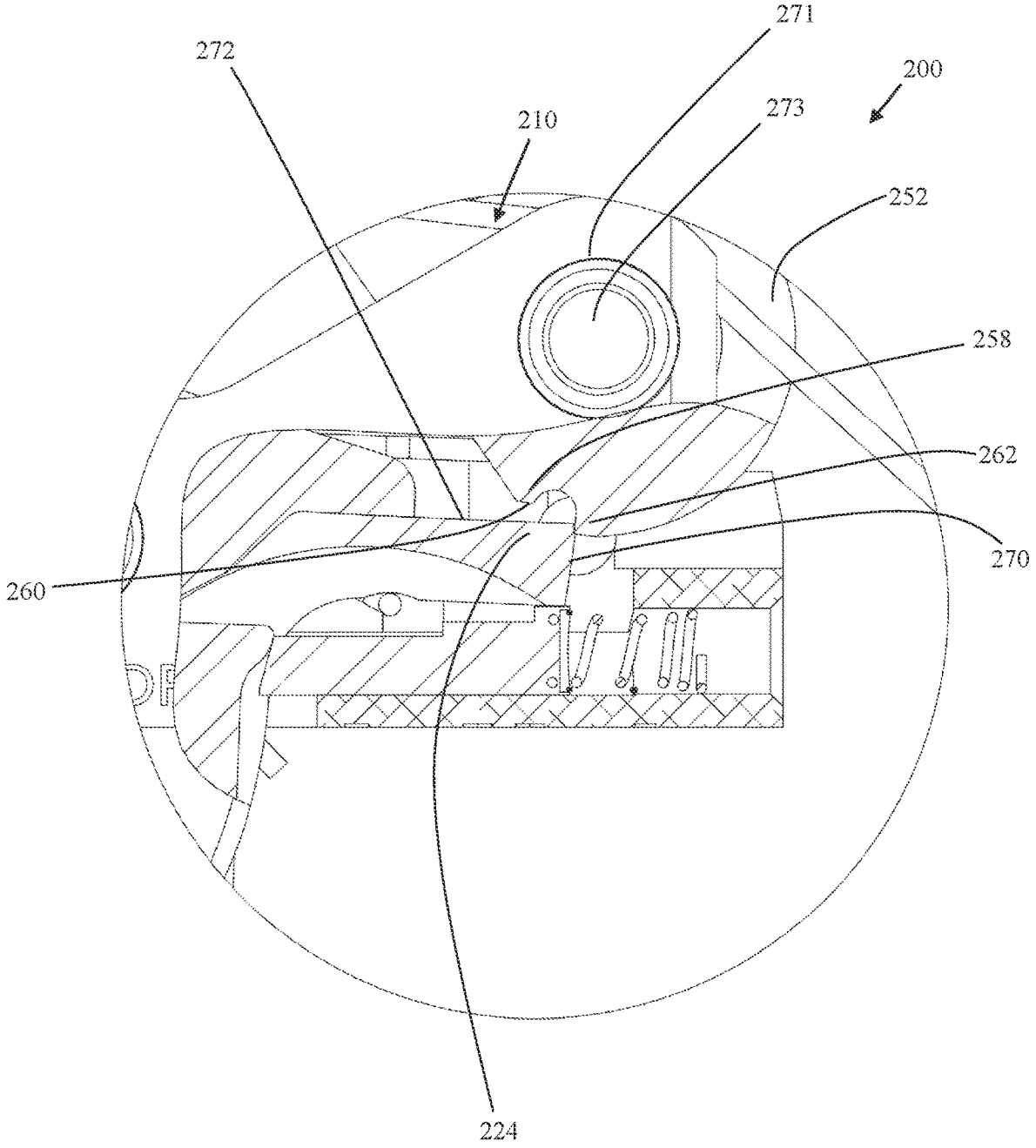
FIG. 11 is a depiction of a portion of the cross-sectional view of the embodiment of the invention shown in FIG. 8, illustrating, among other things, the trigger assembly in the second sear engagement or biased condition of the trigger and hammer.
Figure 12:
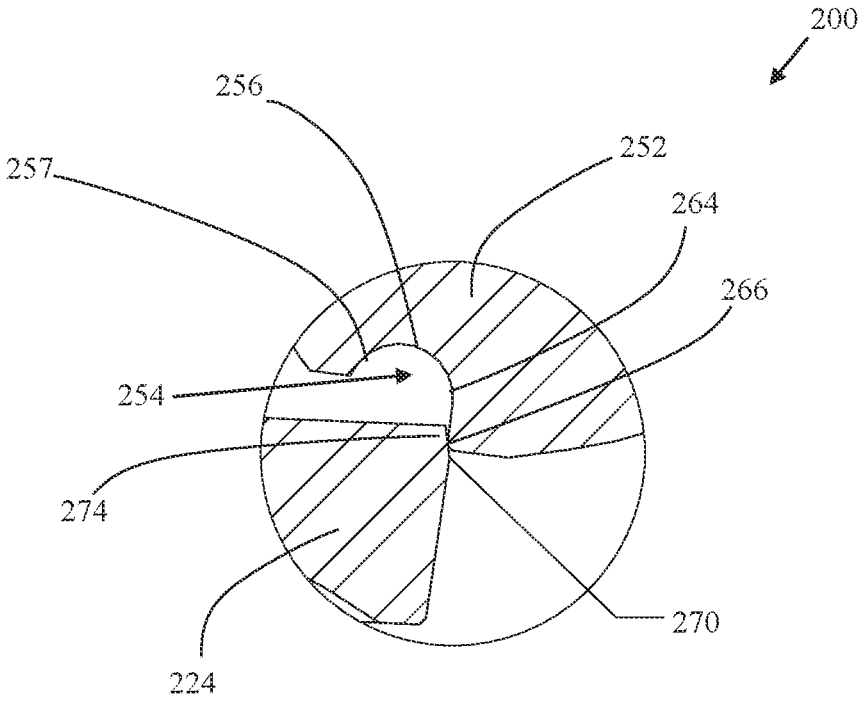
FIG. 12 is a depiction of a portion of the cross-sectional view of the embodiment of the invention shown in FIG. 8, illustrating, among other things, a close-up view of the trigger assembly in the second sear engagement or biased condition of the trigger and hammer.

A second sear engagement condition, as shown in FIGS. 11-12, is formed by pulling the trigger such as the primary trigger 202 against the biasing force resisting motion to overcome the resistance of the trigger biasing force when in the first sear engagement condition, causing movement of the forward portion 224. The biasing force or trigger pull weight may be applied by a trigger spring, among other things, generating a trigger biasing force opposing rearward pivotal motion of the trigger. In the embodiment shown, the second sear engagement condition is formed by pulling primary trigger 202 by itself, that is, while not also pulling secondary trigger 204. In other embodiments, the primary trigger 202 and secondary trigger 204 can be pulled together to achieve the second sear engagement condition. In the embodiment shown, pulling primary trigger 202 and second trigger 204 at the same time releases hammer 210 to discharge the firearm.

As shown, movement of forward portion 224 pursuant to the rearward pivotal motion of the trigger causes a front wall 270 to move from contact with inner sear engagement surface 264 while a second portion 274 of front wall 270 is in contact outer sear engagement surface 266. In this embodiment, second portion 274 defines less surface area than first portion 268. In some embodiments, second portion 274 may extend at a different angle or slope than first portion 268, such as at an angle from about 0.5 degrees to about 60 degrees relative to first portion 268. In some embodiments, second portion 274 is tapered to form a chamfer in front wall 270 of forward portion 224.

In the second sear engagement condition, hammer 210 pivots and cam portion 252 thus changes position causing contact surface 260 to move from being in contact with upper side wall 272 and front wall 270 to move from being in contact with inner sear engagement surface 264. As shown in this embodiment, the only contact between forward portion 224 and cam portion 252 is formed by second portion 274 of front wall 270 being in contact with outer sear engagement surface 266.

The contact between second portion 274 and outer sear engagement surface 266 maintains a state of equilibrium with the biasing force resisting further pivotal motion of primary trigger 202 (that is, the trigger pull weight) at the trigger breakpoint. In other words, in the second sear engagement condition, there will be no additional movement of the second portion 274 against outer sear engagement surface 266 unless a force is applied to overcome the equilibrium, resulting in the release or "breaking" of the contact between the front wall 270 and outer sear engagement surface 266, whereby cam portion 252 is released to allow the pivoting of hammer 210 resulting in discharge of the firearm.

Pulling primary trigger 202 and secondary trigger 204 together while in the second sear engagement condition to overcome the trigger pull weight results in the breaking of the contact between front wall 270 and outer sear engagement surface 266, thus releasing cam portion 252 to move hammer 210. Hammer 210 may strike a cartridge and discharge the firearm. In the embodiment of the invention shown herein, primary trigger 202 and secondary trigger 204 will reset and return to the first sear engagement condition. In other embodiments, the biasing force may be able to be countered when resetting so that primary trigger 202 and secondary trigger 204 reset to the second sear engagement condition without first resetting to the first sear engagement condition.

The trigger pull weights in the first sear engagement condition and the second sear engagement condition may vary, with the trigger pull weight in the first sear engagement condition being greater than the trigger pull weight in the second sear engagement condition. For example, the trigger pull weight in the first sear engagement condition may range from about 2 pounds (0.91 kilograms) to about 6 pounds (2.72 kilograms), and the trigger pull weight in the second sear engagement condition may range from about 0.5 pounds (0.23 kilograms) to about 4 pounds (1.81 kilograms). In some embodiments, the trigger pull weight is double in the first sear engagement condition as compared with the second sear engagement condition. For example, the trigger pull weight may be about 4 pounds in the first sear engagement condition and about 2 pounds and in the second sear engagement condition.

Though many other applications exist, the above disclosure provides an exemplary embodiment of trigger assembly systems well-suited for use with semi-automatic rifles, such as AR-15-style rifles. Additionally, the invention is directed to an improvement to a trigger assembly in an enhanced fire-control system for use in a firearm having a semi-automatic hammer-fired mechanism, such as the enhanced fire-control system disclosed in U.S. Pat. No. 11,274,894, the disclosure of which is incorporated herein.

This written description uses examples to disclose the invention and also to enable any person skilled in the art to practice the invention. The patentable scope of the invention may include other examples that occur to those skilled in the art. Other aspects and features of the invention can be obtained from a study of the drawings and the disclosure. The invention may be practiced otherwise than as specifically described herein. It should also be noted, that the steps and/or functions listed herein, notwithstanding the order of which steps and/or functions are listed, are not limited to any specific order of operation.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein, in the claims and any equivalents thereto.

The invention claimed is:

1. A trigger assembly for use in a firearm having a semi-automatic hammer-fired mechanism, the trigger assembly comprising:

a) a hammer including a cam portion, the hammer being mounted about an axial pin and biased by a hammer biasing force for forward pivotal motion by a hammer spring, the cam portion having a generally circular periphery, the generally circular periphery of the cam portion including: (i) a cutout therein having a bottom, a first side wall and a second side wall, the first side wall and the second side wall opposing one another, wherein the bottom, the first side wall and the second side wall define a radially inner receiving space; (ii) a first sear engagement shoulder, the first sear engagement shoulder comprising the first side wall of the cutout; and (iii) a second sear engagement shoulder, the second engagement shoulder comprising the second side wall of the cutout, the second side wall including an inner sear engagement surface and an outer sear engagement surface, the inner sear engagement surface being in a radially inner position relative to the outer sear engagement surface;

b) a trigger mounted for pivotal motion, the trigger including a forward portion, the forward portion having a front wall, the trigger being biased against rearward pivotal motion by a trigger spring applying a trigger biasing force to maintain the trigger in an unpulled position;

wherein the trigger assembly is configured to enable a first biased condition and a second biased condition;

wherein the first biased condition comprises the forward portion in contact with the first engagement shoulder, the front wall of the forward portion in contact with the inner sear engagement surface of the second engagement shoulder, and the trigger in the unpulled position, whereby the cam portion is restrained preventing the hammer biasing force from causing the hammer to be released for forward biased motion;

wherein the second biased condition comprises the front wall of the forward portion in contact with the outer sear engagement surface of the second engagement shoulder, whereby the cam portion is restrained preventing the hammer biasing force from causing the hammer to be released for forward biasing motion and the trigger biasing force is negated preventing the trigger from returning to the unpulled condition;

wherein, responsive to applying at least a trigger breakpoint force to cause pivotal motion of the trigger in the second biased condition, the front wall of the forward portion disengages from contact with the outer sear engagement surface, whereby the cam portion is unrestrained and the hammer biasing force causes the hammer to be released for forward biasing motion;

wherein the trigger biasing force is greater than the trigger breakpoint force.

2. A trigger assembly as recited in claim 1, wherein the cutout further comprises an arcuate inner surface.

3. A trigger assembly as recited in claim 1, wherein the first sear engagement shoulder includes a planar contact surface configured to contact the forward portion in the first biased condition.

4. A trigger assembly as recited in claim 1, wherein the inner sear engagement surface and the outer sear engagement surface extend at different angles with respect to one another.

5. A trigger assembly as recited in claim 1, wherein the outer sear engagement surface at least partially forms a chamfer in the second sear engagement shoulder.

6. A trigger assembly as recited in claim 1, wherein the front wall defines a lower wall portion and an upper wall portion, the upper wall portion contacting the outer sear engagement surface in the second biased condition.

7. A trigger assembly as recited in claim 6, wherein the upper wall portion is tapered at a different angle with respect to the lower wall portion.

8. A trigger assembly as recited in claim 1, wherein the trigger biasing force is about twice as strong as the trigger breakpoint force.

9. A trigger assembly as recited in claim 1, wherein the forward portion is not in contact with the first engagement shoulder and the front wall of the forward portion is not in contact with the inner sear engagement surface of the second engagement shoulder in the second biased condition.

10. A trigger assembly for use in a firearm having a semi-automatic hammer-fired mechanism, the trigger assembly comprising:

a) a hammer including a cam portion, the hammer being mounted about an axial pin and biased by a hammer biasing force for forward pivotal motion by a hammer spring, the cam portion having a generally circular periphery, the generally circular periphery of the cam portion including: (i) a cutout therein having a bottom, a first side wall and a second side wall, the first side wall and the second side wall opposing one another, wherein the bottom, the first side wall and the second side wall define a radially inner receiving space; (ii) a first sear engagement shoulder, the first sear engagement shoulder comprising the first side wall of the cutout; and (iii) a second sear engagement shoulder, the second engagement shoulder comprising the second side wall of the cutout, the second side wall including an inner sear engagement surface and an outer sear engagement surface, the inner sear engagement surface being in a radially inner position relative to the outer sear engagement surface;

b) a trigger mounted for pivotal motion, the trigger including a forward portion, the forward portion having a front wall, the trigger being biased against rearward pivotal motion by a trigger spring applying a first trigger pull weight to maintain the trigger in an unpulled position;

wherein the forward portion is configured to be in contact with the first engagement shoulder and the front wall is configured to be in contact with at least the inner sear engagement surface in a first biased condition;

wherein the first trigger pull weight on the forward portion is configured to apply resistance to pivotal motion of the trigger in the first biased condition;

wherein the front wall of the forward portion is configured to move from the first biased condition to a second biased condition responsive to pivotal motion of the trigger overcoming the first trigger pull weight;

wherein the front wall of the forward portion is configured to be in contact with only the outer sear engagement surface in the second biased condition;

wherein a second trigger pull weight on the forward portion is configured to apply resistance to pivotal motion of the trigger in the second biased condition, whereby the hammer is prevented from being released;

wherein the hammer is configured to release responsive to pivotal motion of the trigger overcoming the resistance of the second trigger pull weight; and wherein the first trigger pull weight is greater than the second trigger pull weight.

11. A trigger assembly as recited in claim 10, wherein the cutout further comprises an arcuate inner surface.

12. A trigger assembly as recited in claim 10, wherein the first sear engagement shoulder includes a planar contact surface configured to contact the forward portion in the first biased condition.

13. A trigger assembly as recited in claim 10, wherein the inner sear engagement surface is positioned at a first slope and the outer sear engagement surface is positioned at a second slope, the first slope and second slope being different from one another.

14. A trigger assembly as recited in claim 10, wherein the outer sear engagement surface at least partially forms a chamfer in the second sear engagement shoulder.

15. A trigger assembly as recited in claim 10, wherein the front wall defines a lower wall portion and an upper wall portion, the upper wall portion contacting the outer sear engagement surface in the second biased condition.

16. A trigger assembly as recited in claim 15, wherein the upper wall portion is tapered at a different angle with respect to the lower wall portion.

17. A trigger assembly as recited in claim 10, wherein the first trigger pull weight is about twice as strong as the second trigger pull weight.

18. An improvement to a trigger assembly in an enhanced fire-control system for use in a firearm having a semi-automatic hammer-fired mechanism, the enhanced fire-control system including a primary trigger; a secondary trigger pivotably connected to the primary trigger; and a trigger stop located substantially externally to the primary trigger and the secondary trigger and having a stop riser; wherein the secondary trigger actuates force on trigger stop when the secondary trigger is pulled, and wherein the stop riser limits breaking of a sear interface between the primary trigger and the firearm's hammer unless the secondary trigger is pulled, the improvement to the trigger assembly comprising:

a) a hammer including a cam portion, the hammer being mounted about an axial pin and biased by a hammer biasing force for forward pivotal motion by a hammer spring, the cam portion having a generally circular periphery, the generally circular periphery of the cam portion including: (i) a cutout therein having a bottom, a first side wall and a second side wall, the first side wall and the second side wall opposing one another, wherein the bottom, the first side wall and the second side wall define a radially inner receiving space; (ii) a first sear engagement shoulder, the first sear engagement shoulder comprising the first side wall of the cutout; and (iii) a second sear engagement shoulder, the second engagement shoulder comprising the second side wall of the cutout, the second side wall including an inner sear engagement surface and an outer sear engagement surface, the inner sear engagement surface being in a radially inner position relative to the outer sear engagement surface;

b) the primary trigger being mounted for pivotal motion, the trigger including a forward portion, the forward portion having a front wall, the trigger being biased against rearward pivotal motion by a trigger spring applying a trigger biasing force to maintain the trigger in an unpulled position;

wherein the trigger assembly is configured to enable a first biased condition and a second biased condition;

wherein the first biased condition comprises the forward portion in contact with the first engagement shoulder, the front wall of the forward portion in contact with the inner sear engagement surface of the second engagement shoulder, and the trigger in the unpulled position, whereby the cam portion is restrained preventing the hammer biasing force from causing the hammer to be released for forward biased motion;

wherein the second biased condition comprises the front wall of the forward portion in contact with the outer sear engagement surface of the second engagement shoulder, whereby the cam portion is restrained preventing the hammer biasing force from causing the hammer to be released for forward biasing motion and the trigger biasing force is negated preventing the trigger from returning to the unpulled condition;

wherein, responsive to applying at least a trigger breakpoint force to cause pivotal motion of the trigger in the second biased condition while pulling the secondary trigger, the front wall of the forward portion disengages from contact with the outer sear engagement surface, whereby the cam portion is unrestrained and the hammer biasing force causes the hammer to be released for forward biasing motion;

wherein the trigger biasing force is greater than the trigger breakpoint force.

19. The improvement as recited in claim 18, wherein the inner sear engagement surface and the outer sear engagement surface have different angled slopes with respect to one another.

20. The improvement as recited in claim 18, wherein the forward portion is not in contact with the first engagement shoulder and the front wall of the forward portion is not in contact with the inner sear engagement surface of the second engagement shoulder in the second biased condition.

* * * * *